US007895849B2

(12) United States Patent
Chiu

(10) Patent No.: US 7,895,849 B2
(45) Date of Patent: Mar. 1, 2011

(54) DEHUMIDIFIER WITH MULTISTAGE DRAINING

(75) Inventor: Ming-Tsung Chiu, Chung-Ho (TW)

(73) Assignee: New Widetech Industries Co., Ltd., Taipei Hsien (TW)

( * ) Notice: Subject to any disclaimer, the term of this patent is extended or adjusted under 35 U.S.C. 154(b) by 467 days.

(21) Appl. No.: 12/217,465

(22) Filed: Jul. 3, 2008

(65) Prior Publication Data

US 2010/0000242 A1 Jan. 7, 2010

(51) Int. Cl.
*F25D 21/00* (2006.01)
*G05D 22/02* (2006.01)

(52) U.S. Cl. ..... 62/150; 62/285; 236/44 A; 137/398

(58) Field of Classification Search ..... 62/150, 62/176.1, 285, 288, 290, 291; 236/44 A; 137/395, 398

See application file for complete search history.

(56) References Cited

U.S. PATENT DOCUMENTS 5,212,958 A 5/1993 Anderson
5,884,495 A 3/1999 Powell et al.
6,370,902 B1 4/2002 De'Longhi
7,610,697 B2 * 11/2009 Lee ..... 137/135
2009/0084127 A1 * 4/2009 Nakata et al. ..... 62/291
2010/0071399 A1 * 3/2010 Yoon ..... 62/291

FOREIGN PATENT DOCUMENTS

JP 58158436 9/1983

OTHER PUBLICATIONS

European Search and Examination Report dated Oct. 19, 2008, Application No. GB0812656.7.

* cited by examiner

*Primary Examiner* — Marc E Norman
(74) *Attorney, Agent, or Firm* — William E. Pelton, Esq.; Cooper & Dunham LLP

(57) ABSTRACT

A dehumidifier with multistage draining has a container that collects and stores condensed water from a dehumidifying assembly, a float mounted in the container, a float actuator connected to the float and a drain motor connected to the float actuator and an attachment actuator having a switch. When an external pipe is connected to the attachment connector to switch on the switch and the condensed water in the container gradually raises the float to switch on the float actuator, the drain motor is switched on to pump the condensed water out of the container. The dehumidifier automatically drains condensed water in the container according to the quantity of the condensed water, does not have to be cleared frequently and is convenient.

16 Claims, 11 Drawing Sheets

DEHUMIDIFIER WITH MULTISTAGE DRAINING

BACKGROUND OF THE INVENTION

1. Field of the Invention

The present invention relates to a dehumidifier, especially to a dehumidifier with multistage draining for condensing gaseous water in the air into condensed water to lower humidity of the surroundings.

2. Description of the Prior Arts

A dehumidifier is a common electric appliance that regulates indoor humidity. The dehumidifier sucks and cools humid air to condense gaseous water in the humid air into condensed water and therefore to separate the humid air into dry air and condensed water. Then the dehumidifier heats and exhausts the dry air out of the dehumidifier. Therefore the humidity of the surroundings is lowered and the surroundings become comfortable. Dehumidifiers may also be implemented to protect buildings to dry out walls after flooding or the like.

A conventional dehumidifier has a container that stores condensed water. When the container is filled with condensed water, the conventional dehumidifier signals an alarm to allow people to clear the condensed water from inside the container or the conventional dehumidifier will automatically shot off due to a safety device inside the conventional dehumidifier.

However, the conventional dehumidifier is inconvenient. When the surroundings remains humid, the container should be cleared frequently or requires a bigger container to allow the conventional dehumidifier to remain operational. When the container is removed for emptying, the dehumidifier will also cease operation, lowering efficiency. Moreover, the dehumidifier must be monitored, so when left running at night, the dehumidifier may fill and cease operation and this may increase damage to buildings or cause discomfort.

To overcome the shortcomings, the present invention provides a dehumidifier with multistage draining to mitigate or obviate the aforementioned problems.

SUMMARY OF THE INVENTION

The main objective of the present invention is to provide a dehumidifier with multistage draining that has a dehumidifying assembly, a container, a float being mounted in the container, a float actuator being connected to the float, an attachment actuator and a drain motor being electrically connected to the float actuator and the attachment actuator. The container collects and stores condensed water from the dehumidifying assembly. The attachment actuator has a switch.

When an external pipe is connected to the attachment connector to actuate the switch and the condensed water in the container raises the float to actuate the float actuator, the drain motor is switched on to pump the condensed water out of the container. The dehumidifier automatically drains the condensed water in the container according to the quantity of the condensed water. Therefore, the dehumidifier does not have to be cleared frequently and is convenient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
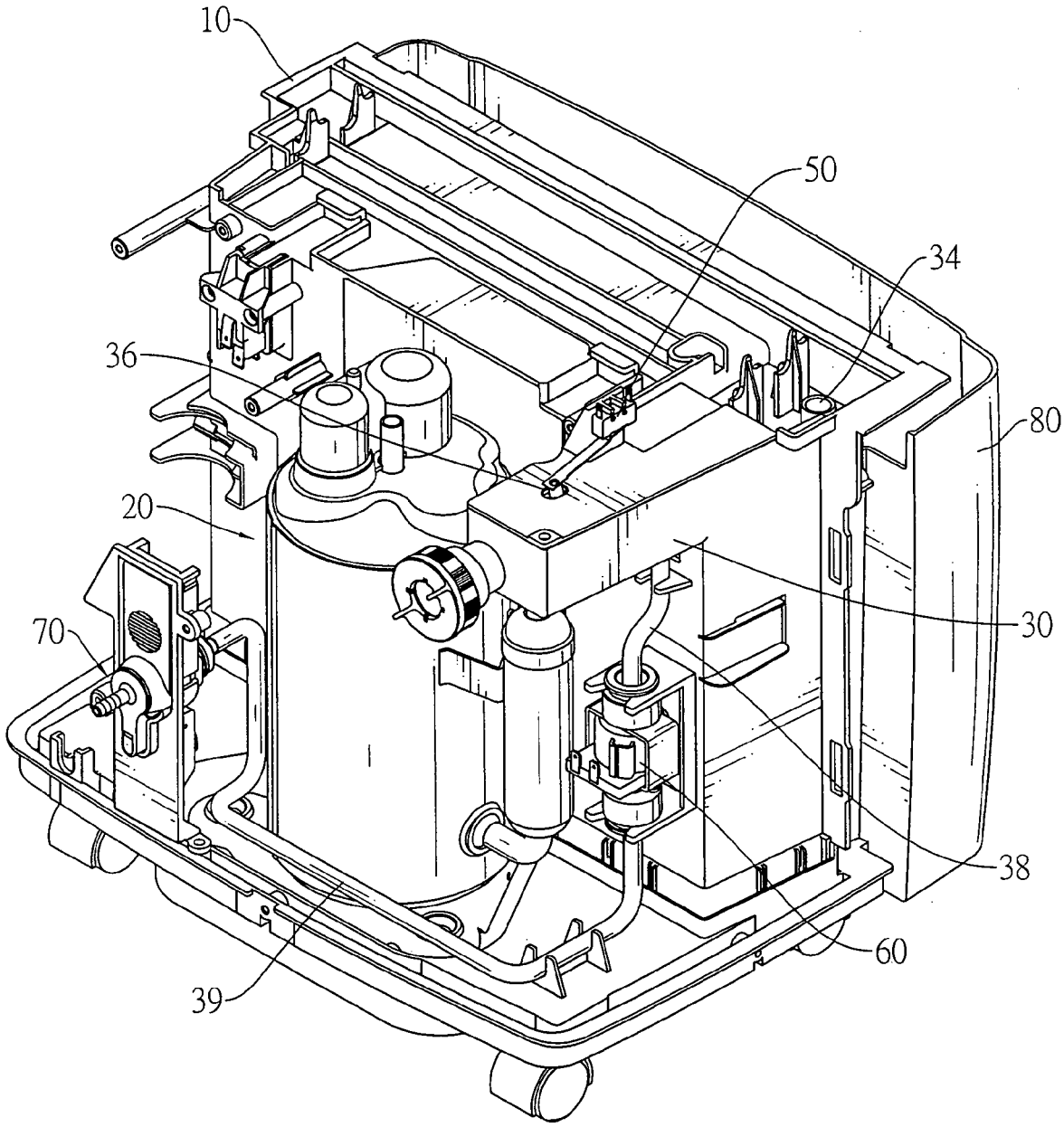
FIG. 1 is a perspective view of a dehumidifier with multistage draining in accordance with the present invention.
Figure 2:
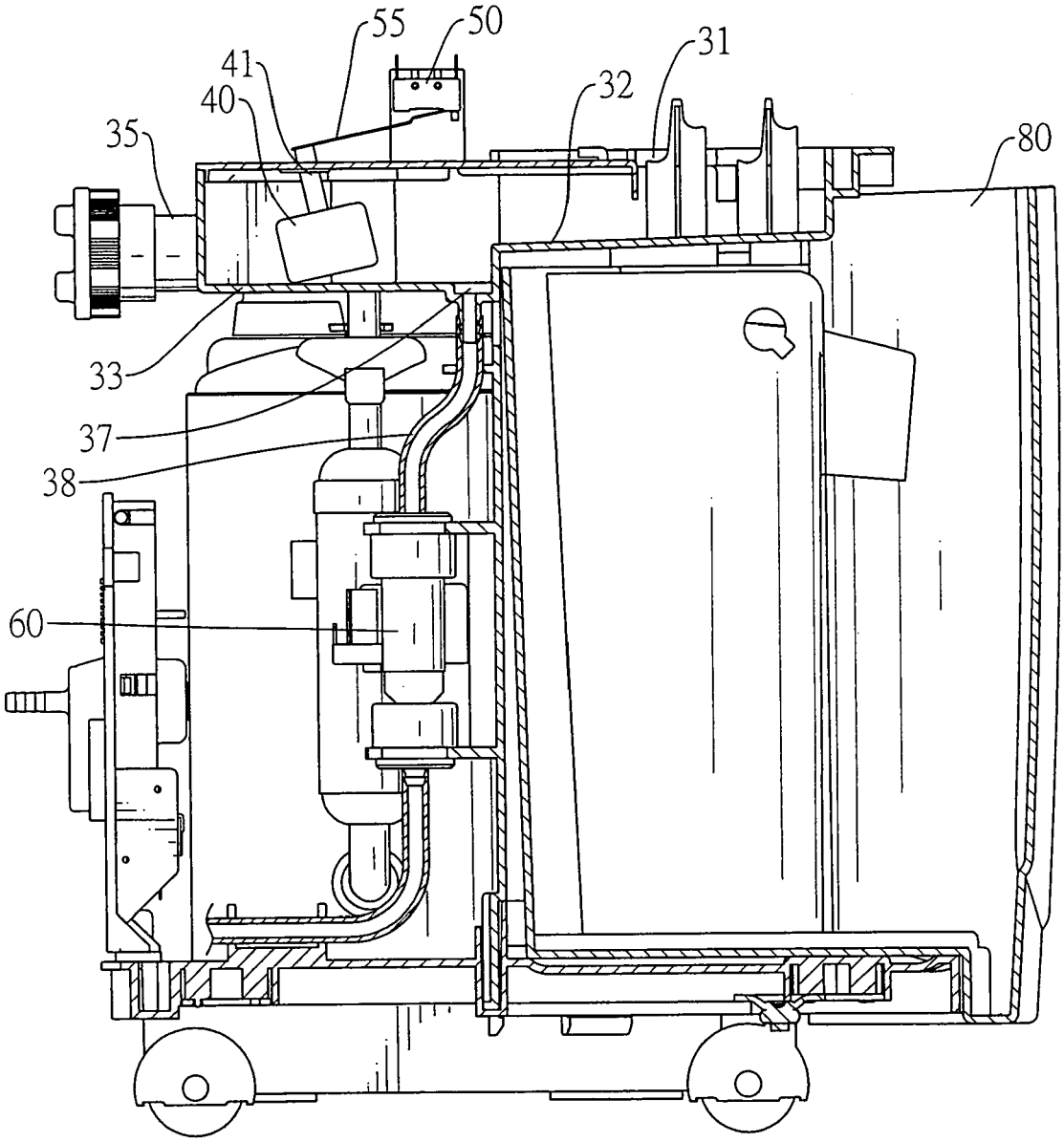
FIG. 2 is a side view in partial section of the dehumidifier in FIG. 1.

With reference to FIGS. 1 and 2, a dehumidifier with multistage draining comprises a housing (10), a dehumidifying assembly (20), a container (30), a float (40), a float actuator (50), an attachment actuator (70), a drain motor (60), a drain pipe (38), a connecting pipe (39) and a water-storage tank (80).

Figure 3:
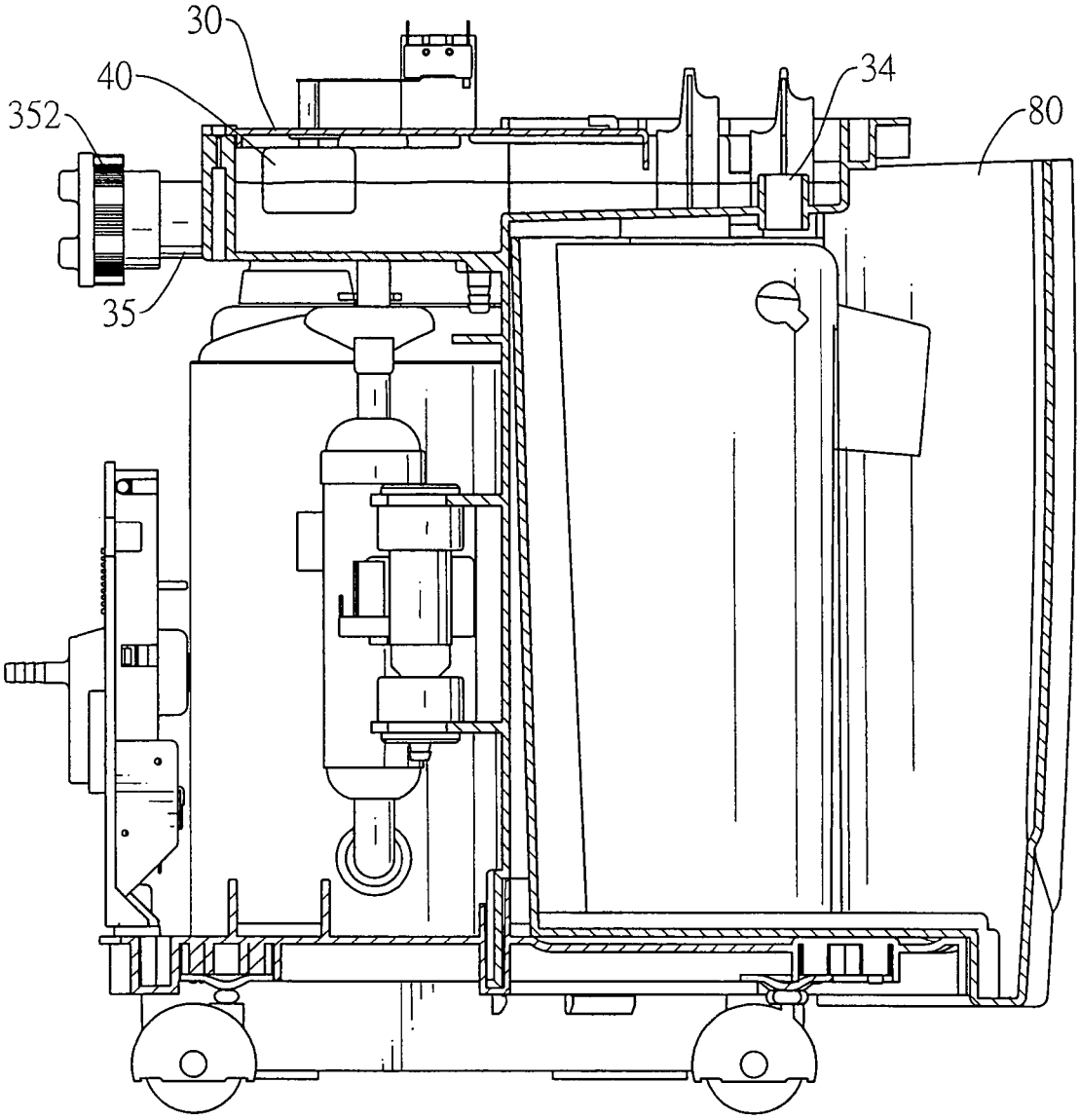
FIG. 3 is another side view in partial section of the dehumidifier in FIG. 1, showing a float being raised.
Figure 4:
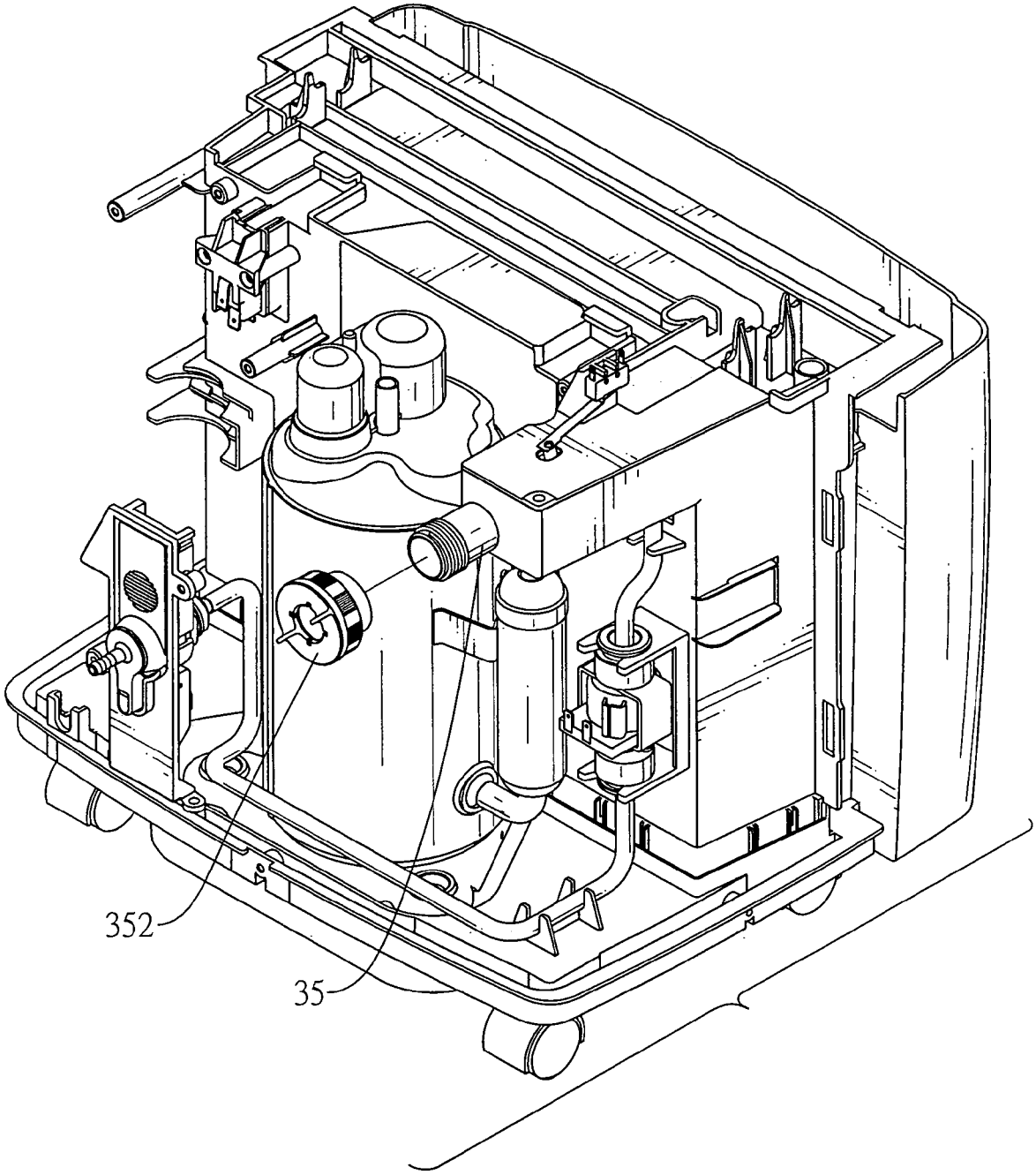
FIG. 4 is a partially exploded perspective view of the dehumidifier in FIG. 1.

The dehumidifying assembly (20) is mounted in the housing (10), sucks humid air into the housing (10), cools the humid air to condense gaseous water into condensed water, thereby separating the humid air into dry air and the condensed water to dehumidify the humid air, heats and exhausts the dry air out of the housing (10), maybe using a heat exchanger and may have a compressor, a radiator, a fan and so forth as well known and described in the art. With further reference to FIGS. 3 and 4, the container (30) is mounted in the housing (10), stores the condensed water from the dehumidifying assembly (20) and has an inner end, an outer end, a top, a bottom, an opening (31), an optional collecting tube (34), an optional connecting tube (35), an optional cap (352), a through hole (36) and a drain hole (37).

The bottom of the container (30) may have an outer bottom (33) and an inner bottom (32). The inner bottom (32) is shallower than the outer bottom (33) and is sloped from the inner end of the container (30) to the outer bottom (33) of the container (30).

The opening (31) is formed through the top of the container (30) and may correspond to the inner bottom (32) of the container (30) to allow the condensed water from the dehumidifying assembly (20) to enter the container (30) and to flow from the inner bottom (32) of the container (30) to the outer bottom (33) of the container (30).

The collecting tube (34) is formed on and protrudes transversely through the bottom of the container (30), may be formed on and protrude transversely through the inner bottom (32) of the container (30) and has an inner open end. The inner open end of the collecting tube (34) protrudes higher than the bottom of the container (30) and may protrude higher than the inner bottom (32) of the container (30).

The connecting tube (35) is formed on and protrudes from the outer end of the container (30), communicates with the container (30) and has a distal open end.

The cap (352) is detachably mounted on the distal open end of the connecting tube (35) to selectively seal the connecting tube (35) when attached to the distal open end of the connecting tube (35) and to allow the condensed water inside the container (30) to flow out of the container (30) through the connecting tube (35) when detached from the distal open end of the connecting tube (35).

The through hole (36) is formed through the top of the container (30) and may correspond to the outer bottom (33) of the container (30).

The drain hole (37) is formed through the bottom of the container (30) and may be formed through the outer bottom (33) of the container (30).

The float (40) is mounted in the container (30) and has a connecting rod (41). The connecting rod (41) is connected to the float (40), is mounted through the through hole (36) of the container (30) and protrudes out of the container (30).

Figure 5:
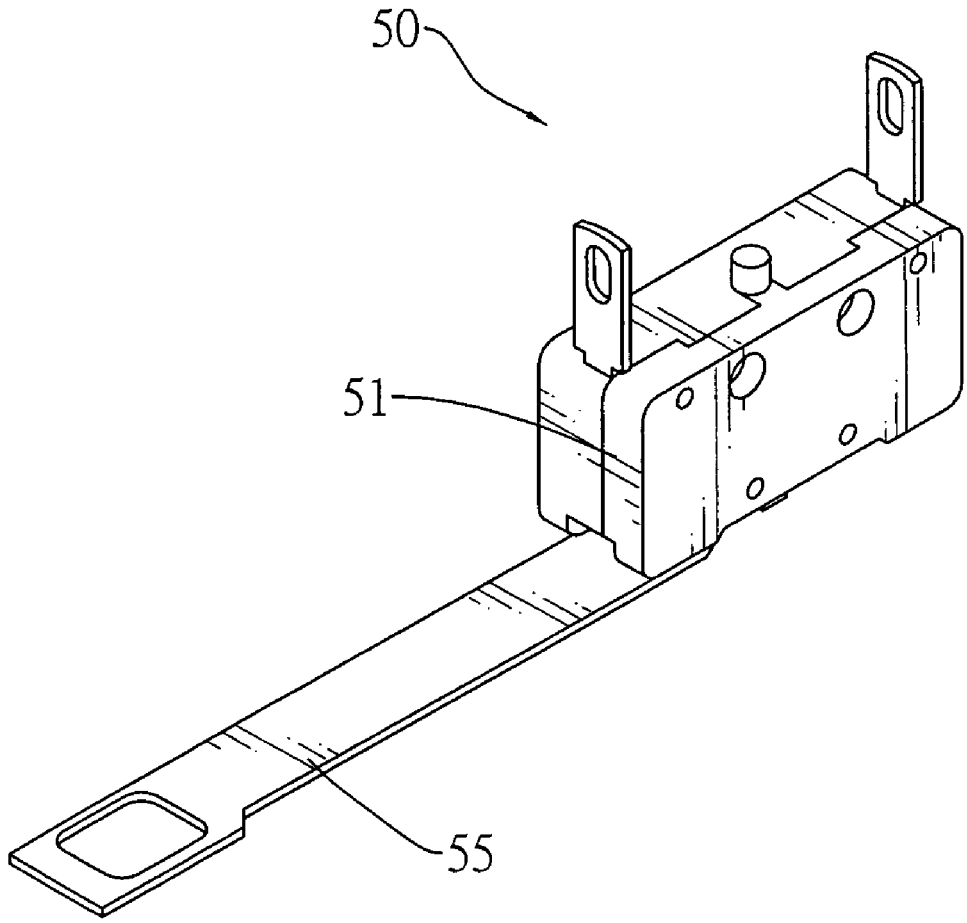
FIG. 5 is an enlarged perspective view of a float actuator of the dehumidifier in FIG. 1.
Figure 6:
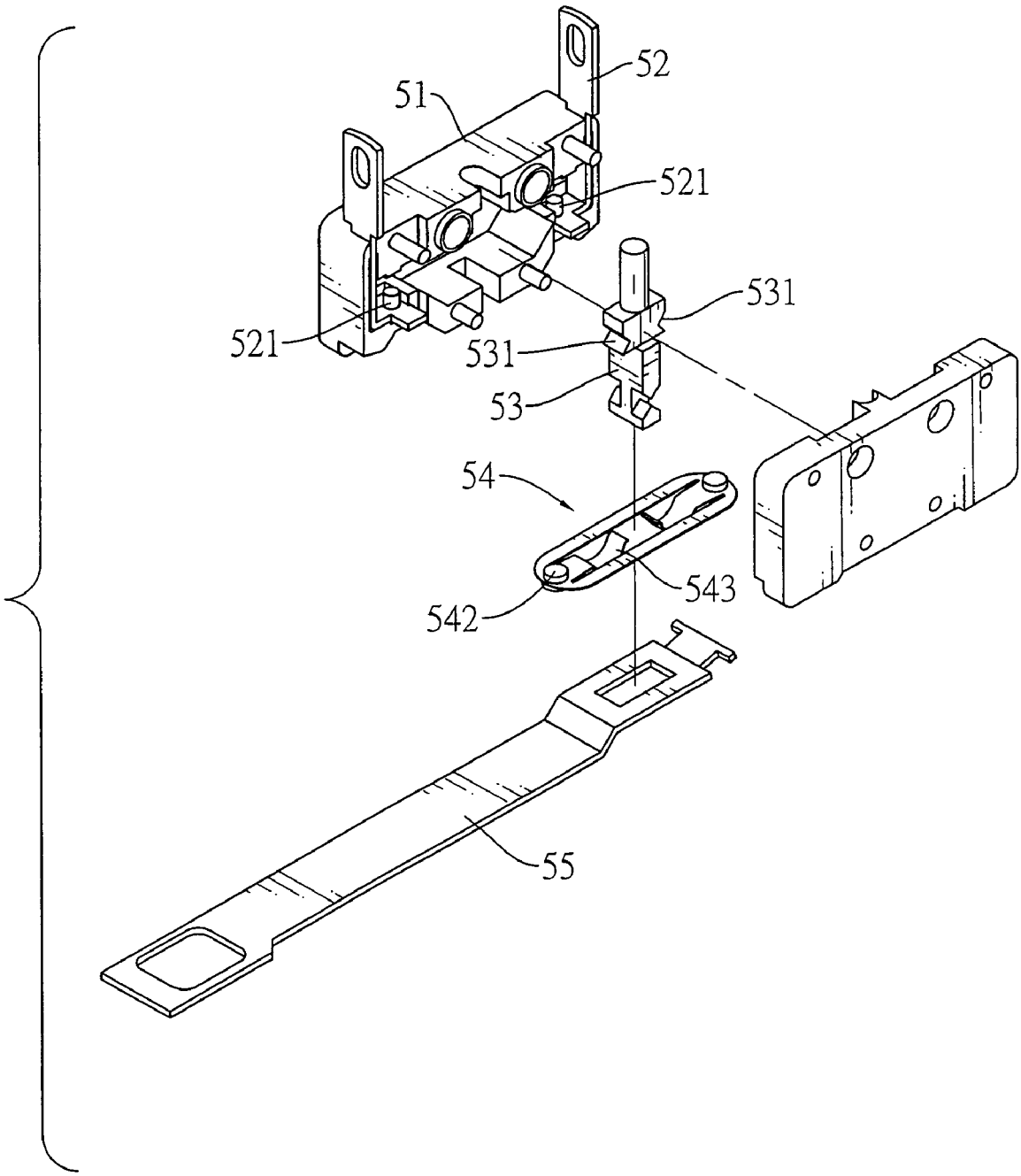
FIG. 6 is an exploded perspective view of the float actuator of the dehumidifier in FIG. 5.
Figure 7:
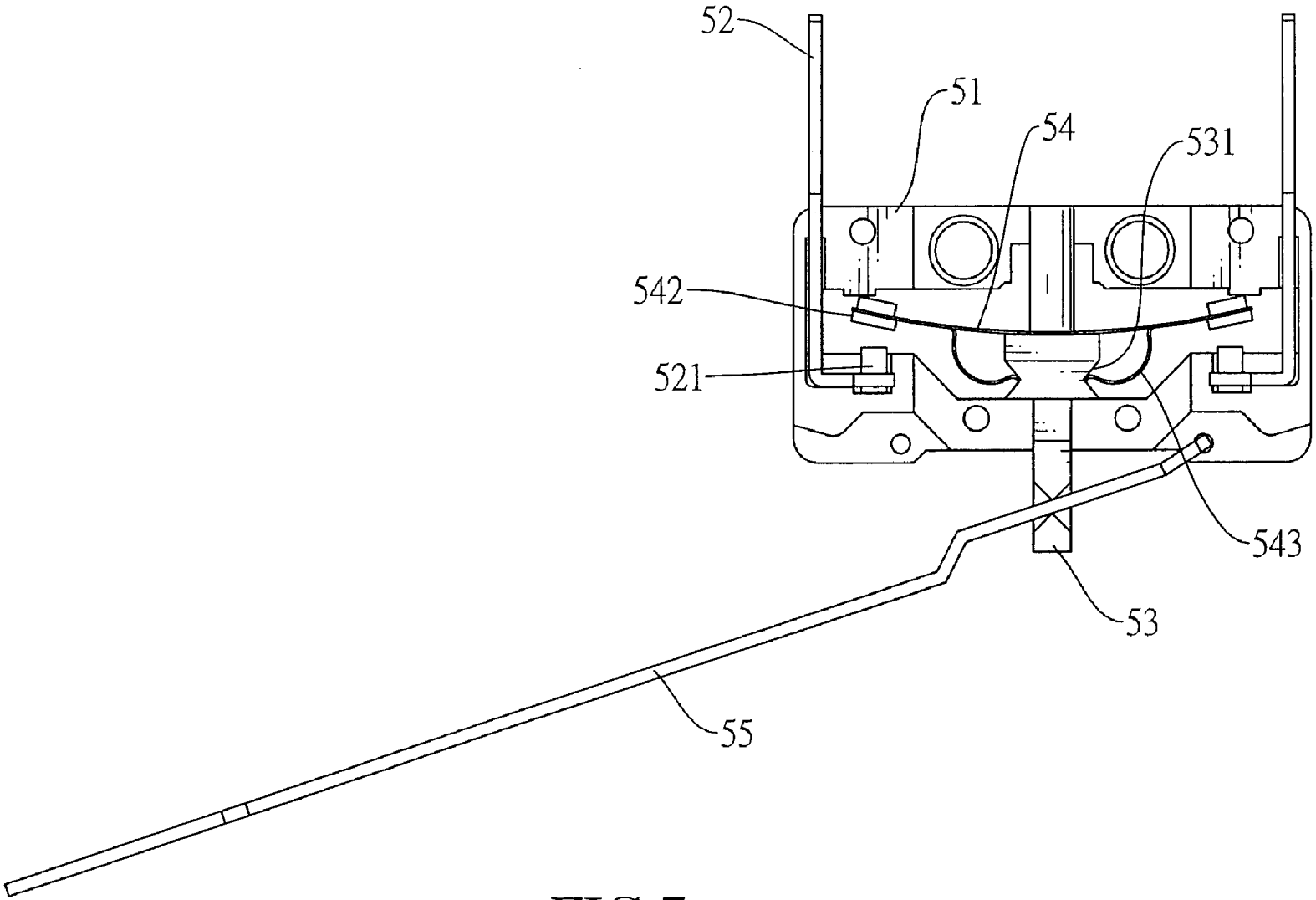
FIG. 7 is a side view of the float actuator of the dehumidifier in FIG. 5.

With further reference to FIGS. 5 to 7, the float actuator (50) is mounted in the housing (10), is connected to the float (40) and may have a case (51), two terminals (52), a driving connector (53), an annular connector (54) and a connecting rod (55).

The case (51) has a top and a bottom.

The terminals (52) are oppositely mounted in the case (51) and protrude through the top of the case (51). Each terminal (52) has an outer end, an inner end and a conducting protrusion (521). The conducting protrusion (521) is formed on the inner end of the terminal (52).

The driving connector (53) is mounted in the case (51) and between the terminals (52), protrudes through the top and the bottom of the case (51) and has an upper end, a lower end, a side surface and two mounting recesses (531). The upper end of the driving connector (53) protrudes out of the top of the case (51). The lower end of the driving connector (53) protrudes out of the bottom of the case (51). The mounting recesses (531) are oppositely formed in the side surface of the driving connector (53).

The annular connector (54) is elastic, is mounted in the case (51), between the terminals (52) and around the driving connector (53) and has two opposite ends, an inner edge, two conducting protrusions (542) and two elastic positioning protrusions (543). The conducting protrusions (542) are respectively formed on the annular connector (54) adjacent to the ends of the annular connector (54) and respectively correspond to the conducting protrusions (521) of the terminals (52). The elastic positioning protrusions (543) are respectively formed on the inner edge of the annular connector (54), respectively correspond to the ends of the annular connector (54) and respectively engage the mounting recesses (531) of the driving connector (53).

When the driving connector (53) moves up and down relative to the case (51), the corresponding conducting protrusions (521, 542) of the terminals (52) and the conducting assembly (54) selectively connect with and disconnect from each other.

The connecting rod (55) is pivotally connected to the bottom of the case (51), is mounted around the lower end of the driving connector (53), is securely connected to the connecting rod (41) of the float (40) to drive the driving connector (53) to move up and down relative to the case (51) and has a proximal end and a distal end. The proximal end of the connecting rod (55) is pivotally connected to the bottom of the case (51). The distal end of the connecting rod (55) is connected to the connecting rod (41) of the float (40).

Figure 8:
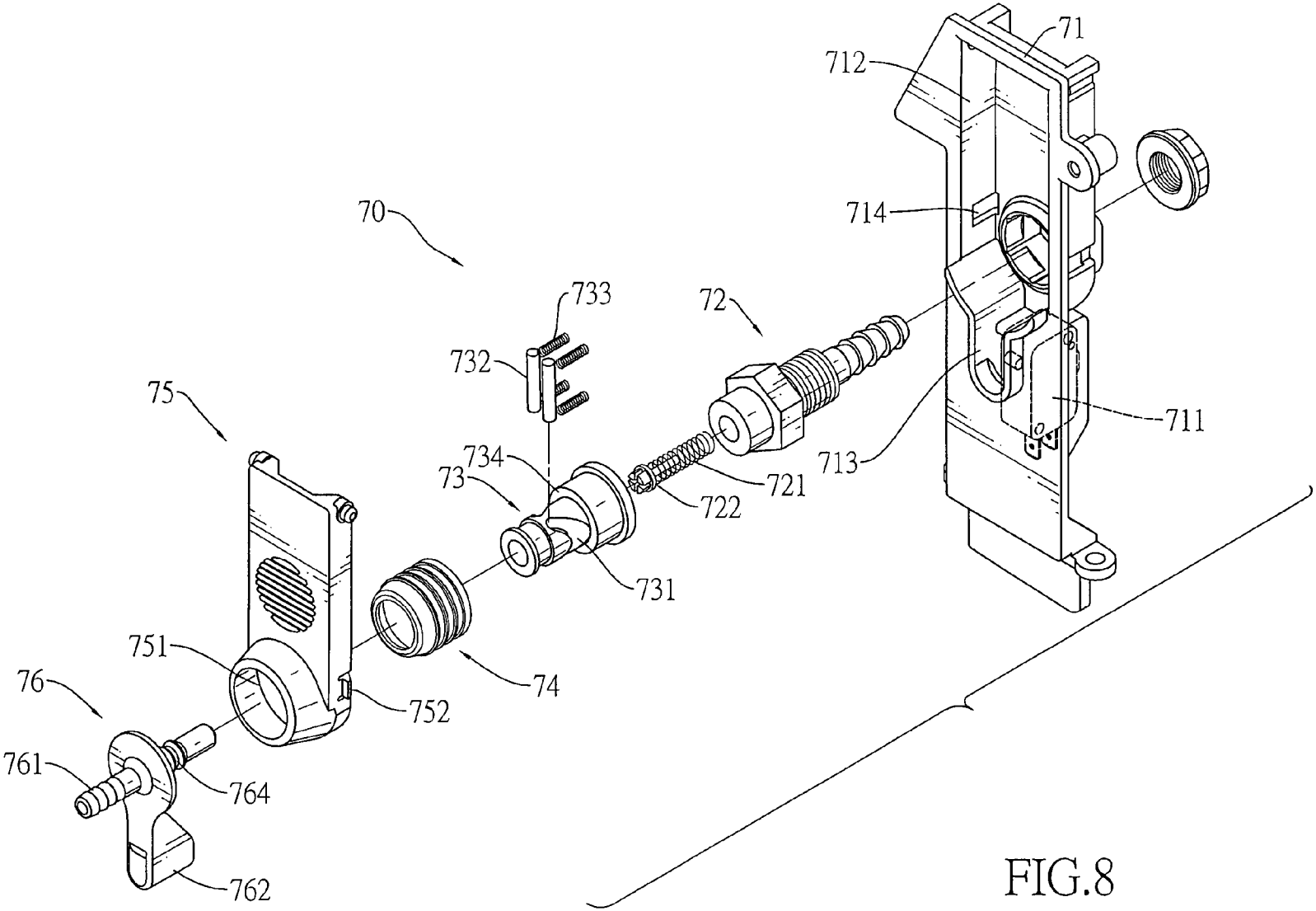
FIG. 8 is an enlarged exploded perspective view of a attachment actuator of the dehumidifier in FIG. 1.
Figure 9:
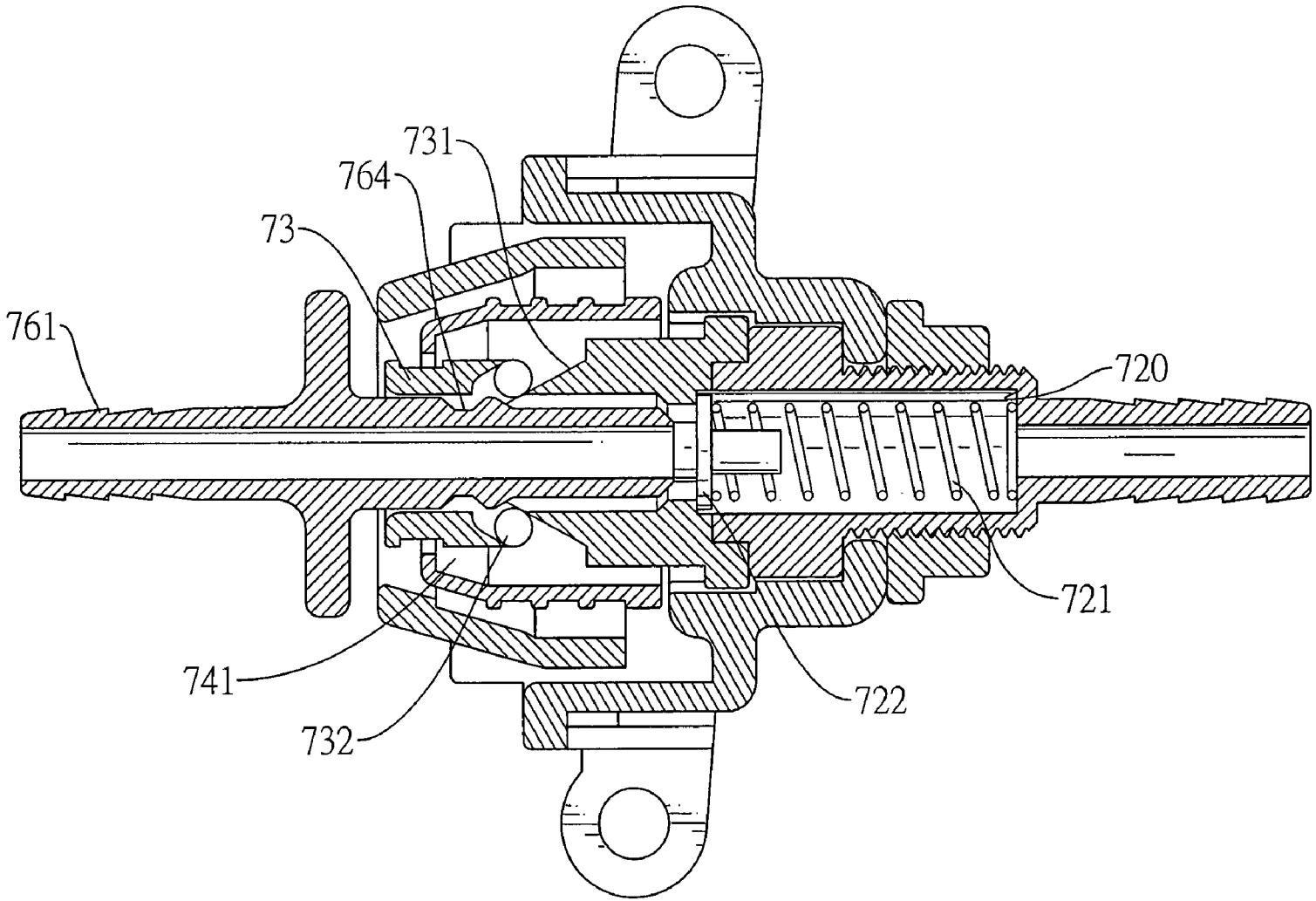
FIG. 9 is a side view in partial section of the attachment actuator of the dehumidifier in FIG. 8.

With further reference to FIGS. 8 and 9, the attachment actuator (70) is tubular, is mounted on the housing (10), extends out of the housing (10), has a switch (711) and may have a mounting cover (71), a restore assembly (72), a middle assembly (73), a sustaining assembly (74), a positioning cover (75) and an attachment connector (76).

The mounting cover (71) is mounted on the housing (10) and has an outer surface, an inner surface, a mounting recess (712), a Y-shaped recess (713) and two positioning holes (714). The mounting recess (712) is formed in the outer surface of the mounting cover (71) and has two opposite side surfaces. The Y-shaped recess (713) is formed in the outer surface of the mounting cover (71) and communicates with the mounting recess (712) of the mounting cover (71). The positioning holes (714) are respectively formed through the side surfaces of the mounting recess (712).

The switch (711) may be mounted on the inner surface of the mounting cover (71).

The restore assembly (72) is tubular, is mounted through the mounting cover (71) in the mounting recess (712) of the mounting cover (71) and has an outer open end, an inner open end, an annular shoulder (720), a spring (721) and a stopper (722). The annular shoulder (720) is formed around the inner surface of the restore assembly (72). The spring (721) is mounted in the restore assembly (72) between the outer open end and the annular shoulder (720) of the restore assembly (72) and has an inner end and an outer end. The inner end of the spring (721) abuts the annular shoulder (720) of the restore assembly (72). The stopper (722) is mounted on the outer end of the spring (721) of the restore assembly (72) and corresponds to the outer open end of the restore assembly (72).

The middle assembly (73) is tubular, is connected to and aligns with the restore assembly (72) and has an inner open end, an outer open end, an outer surface, an annular shoulder (734), two arc recesses (731), two pins (732) and four springs (733). The inner open end of the middle assembly (73) is mounted around the outer open end of the restore assembly (72). The annular shoulder (734) of the middle assembly (73) is formed around the outer surface of the middle assembly (73). The arc recesses (731) are formed through the outer surface of the middle assembly (73). Each arc recess (731) has two ends. The ends of the arc recess (731) correspond to each other. The pins (732) are respectively mounted through the arc recesses (731). Each pin (732) is mounted in the ends of the corresponding arc recess (731) and has two ends. The springs (733) are respectively mounted between the ends of the pins (732) and the annular shoulder (734) of the middle assembly (73).

The sustaining assembly (74) is tubular, is mounted around the middle assembly (73) and in the mounting recess (712) of the mounting cover (71) and has an inner open end, an outer open end, an inner surface and an annular shoulder (741). The inner open end of the sustaining assembly (74) abuts the mounting cover (71). The annular shoulder (741) of the sustaining assembly (74) is formed around the inner surface of the sustaining assembly (74) adjacent to the outer open end of the sustaining assembly (74) and abuts the pins (732) of the middle assembly (73).

The positioning cover (75) is pivotally connected to the mounting cover (71) in the mounting recess (712) of the mounting cover (71), corresponds to the restore assembly (72), may be selectively mounted in the mounting recess (712) of the mounting cover (71), may press against the outer open end of the sustaining assembly (74) to hold the sustaining assembly (74) between the positioning cover (75) and the middle assembly (73) and has two opposite side surfaces, a through hole (751) and two positioning protrusions (752). The through hole (751) of the positioning cover (75) is formed through the positioning cover (75) and may correspond to the sustaining assembly (74). The positioning protrusions (752) are respectively formed on the side surfaces of the positioning cover (75), correspond to and selectively engage the positioning holes (714) of the mounting cover (71) to allow the positioning cover (75) to be securely mounted in the mounting recess (712) of the mounting cover (71).

The attachment connector (76) is mounted on the positioning cover (75), in the Y-shaped recess (713) of the mounting cover (71) and through the through hole (751) of the positioning cover (75), corresponds to the switch (711) and may have a connecting tube (761) and a button (762). The connecting tube (761) is tubular, is mounted through the through hole (751) of the positioning cover (75) and in the middle assembly (73), abuts the stopper (722) of the restore assembly (72) and has an inner end, an outer end, an outer surface and an annular recess (764). The inner end of the connecting tube (761) abuts the stopper (722) of the restore assembly (72). The annular recess (764) is formed around the connecting tube (761) and corresponds to the arc recesses (731) of the middle assembly (73). The button (762) corresponds to and is mounted in the Y-shaped recess (713) of the mounting cover (71) and selectively presses against the switch (711) of the mounting cover (71).

The drain motor (60) is mounted in the housing (10), is electrically connected to the terminals (52) of the float actuator (50) and the switch (711) of the attachment actuator (70), is selectively switched on when the float actuator (50) and the switch (711) of the attachment actuator (70) are switched on and may be selectively switched on when the terminals (52) of the float actuator (50) are connected to the annular connector (54) of the float actuator (50) and the button (762) of the attachment connector (76) press against the switch (711) of the mounting cover (71).

The drain pipe (38) is connected to the drain hole (37) of the container (30) and the drain motor (60).

The connecting pipe (39) is connected to the drain motor (60) and the attachment actuator (70) and may be connected to the inner open end of the restore assembly (72) of the attachment actuator (70).

When the drain motor (60) is switched on, the condensed water that is collected in the container (30) flows through the drain pipe (38), the drain motor (60), the connecting pipe (39) and the attachment actuator (70) to flows out of the dehumidifier as described.

The water-storage tank (80) is mounted in the housing (10) and communicates with the collecting tube (34) of the container (30).

With reference to FIGS. 2 and 7, when there is no condensed water in the container (30), the float (40) and the distal end of the connecting rod (55) of the float actuator (50) move down toward the front bottom of the container (30). Consequently, the driving connector (53) of the float actuator (50) and the elastic positioning protrusions (543) of the annular connector (54) that engage the mounting recesses (531) of the driving connector (53) are pulled down. Therefore, the annular connector (54) is bent and the conducting protrusions (542) of the annular connector (54) disconnect from the conducting protrusions (521) of the terminals (52). The float actuator (50) is switched off.

With reference to FIG. 9, when the spring (721) of the restore assembly (72) pushes the stopper (722), the stopper (722) seals the tubular restore assembly (72) and pushes the restore assembly (72) outwardly to allow the button (762) of the attachment connector (76) to move away from the switch (711) of the mounting cover (71) of the attachment actuator (70). Therefore, the switch (711) of the mounting cover (71) of the attachment actuator (70) is off.

Thus, the drain motor (60) is switched off while the float actuator (50) and the switch (711) of the mounting cover (71) of the attachment actuator (70) are switched off.

Figure 10:
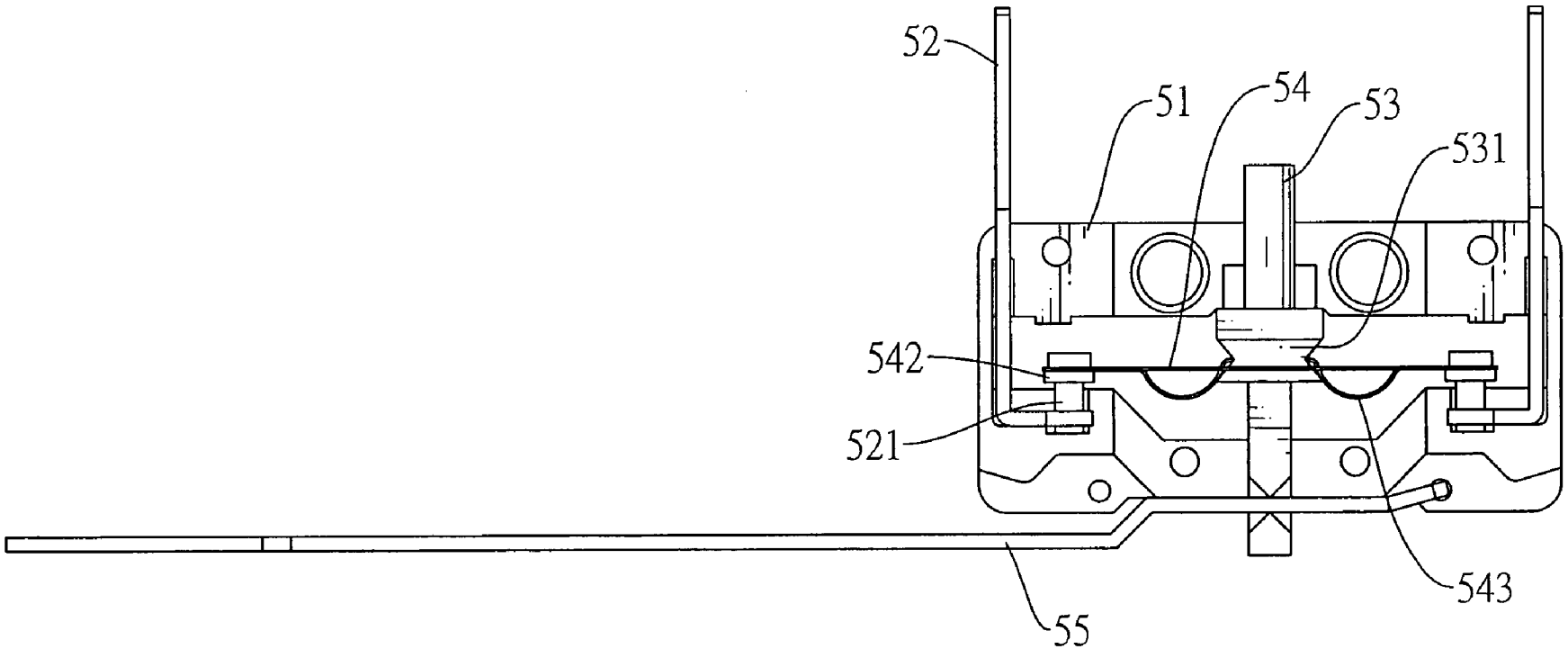
FIG. 10 is another side view of the float actuator of the dehumidifier in FIG. 5.

With farther reference to FIGS. 3 and 10, as the condensed water from the dehumidifying assembly (20) is gradually collected in and stored in the container (30), the float (40) and the distal end of the driving connector (53) of the float actuator (50) rise corresponding to a level of the condensed water. Once enough condensed water is held by the container (30) the driving connector (53) of the float actuator (50) rises high enough to push the elastic positioning protrusions (543) of the annular connector (54), the annular connector (54) is elastically inverted. Therefore, the conducting protrusions (542) of the annular connector (54) connect the conducting protrusions (521) of the terminals (52). The float actuator (50) is switched on.

Figure 11:
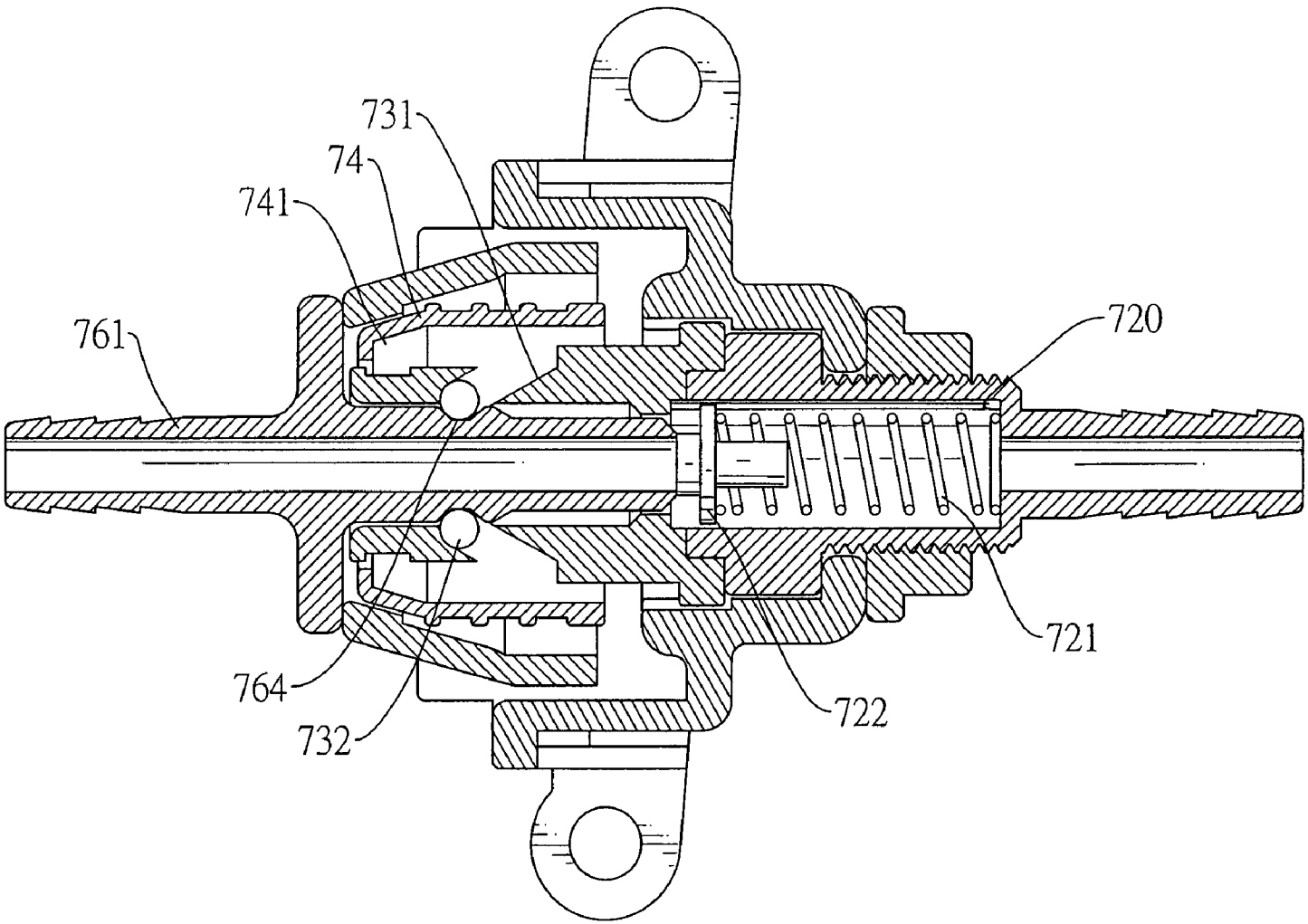
FIG. 11 is another side view in partial section of the attachment actuator of the dehumidifier in FIG. 8.

With further reference to FIG. 11, when an external pipe is connected to the connecting tube (761) of the attachment connector (76) and pushes the attachment connector (76), the attachment connector (76) further pushes the positioning cover (75). Therefore, the button (762) of the attachment connector (76) presses against and switches on the switch (711) of the mounting cover (71). Furthermore, the spring (721) of the restore assembly (72) is compressed and the pins (732) of the middle assembly (73) are mounted into the annular recess (764) of the attachment connector (76) to lock the attachment connector (76) in a specific position.

Thus, the drain motor (60) is switched on when both the float actuator (50) and the switch (711) of the mounting cover (71) of the attachment actuator (70) are switched on. Therefore, the condensed water stored in the container (30) is pumped out of the container (30), flows through the drain pipe (38), the connecting pipe (39), the restore assembly (72) and the connecting tube (761) of the attachment connector (76) and then is drained out of the dehumidifier as described.

As long as the condensed water gradually flows out of the container (30), the float (40) and the distal end of the connecting rod (55) of the float actuator (50) move down toward the front bottom of the container (30). However, the conducting protrusions (542) of the annular connector (54) remain connected to the conducting protrusions (521) of the terminals (52) because of the elasticity of the annular connector (54). Therefore, the drain motor (60) keeps pumping the condensed water out of the container (30) and the connecting rod (55) keeps pulling the elastic positioning protrusions (543) of the annular connector (54). Once the annular connector (54) is inverted again and the conducting protrusions (542) of the annular connector (54) disconnect from the conducting protrusions (521) of the terminals (52) the drain motor (60) is switched off.

Consequently, with the elasticity of the annular connector (54) of the float actuator (50), the drain motor (60) will stop working after operating over a specific time and pumping a specific quantity of water out of the container (60).

Moreover, the positioning cover (75) can be pushed to move the sustaining assembly (74) to allow the annular shoulder (741) of the sustaining assembly (74) to push the pins (732) of the middle assembly (73). Thus, the pins (732) respectively move along the corresponding arc recesses (731) of the middle assembly (73) and out of the annular recess (764) of the switch connector (76). At this moment, with the spring (721) of the restore assembly (72) push the stopper (722) and the attachment connector (76) and the springs (733) of the middle assembly (73) pushing the pins (732) of the middle assembly (73), the button (762) of the attachment connector (76) is moved away from the switch (711) of the mounting cover (71). Therefore, the drain motor (60) is switched off.

Consequently, the drain motor (60) can be switched off by pressing the attachment actuator (70).

In addition, when the condensed water in the container (30) gets more and more and is higher than the inner open end of the collecting tube (34) of the container (30), the condensed water will flows through the collecting tube (34) and into the water-storage tank (80). Therefore, even though the electric power is cut or the drain motor (60) breaks down, the condensed water in the container (30) can still be drained out of the container (30).

The dehumidifier as described has the following advantages. The drain motor (60) is switched on to drain the condensed water in the container (30) when the float actuator (50) and the attachment actuator (70) are switched on at the same time. The dehumidifier as described automatically drains the condensed water in the container (30) according to the quantity of the condensed water in the container (30). Therefore, the dehumidifier does not have to be cleared frequently and is convenient.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. The dehumidifier comprising
- a housing;
- a dehumidifying assembly being mounted in the housing;
- a container being mounted in the housing and having
  - a top;
  - a bottom;
  - an opening being formed through the top of the container;
  - a through hole being formed through the top of the container; and
  - a drain hole being formed through the bottom of the container;
- a float being mounted in the container and having a connecting rod being connected to the float, being mounted through the through hole of the container and protruding out of the container;
- a float actuator being mounted in the housing and being connected to the float;
- an attachment actuator being tubular, being mounted on the housing, extending out of the housing and having a switch;
- a drain motor being mounted in the housing, being electrically connected to the terminals of the float actuator and the switch of the attachment actuator and being selectively switched on when the float actuator and the switch of the attachment actuator are switched on;
- a drain pipe being connected to the drain hole of the container and the drain motor;
- a connecting pipe being connected to the drain motor and the attachment actuator.

2. The dehumidifier as claimed in claim 1, wherein the container further has
- an outer end;
- a connecting tube being formed on and protruding from the outer end of the container, communicating with the container and having a distal end; and
- a cap being detachably mounted on the distal end of the connecting tube.

3. The dehumidifier as claimed in claim 2, wherein the float actuator further has
- a case having
  - a top; and
  - a bottom;
- two terminals being oppositely mounted in the case and protruding through the top of the case and each terminal having
  - an outer end;
  - an inner end; and
  - a conducting protrusion being formed on the inner end of the terminal;
- a driving connector being mounted in the case and between the terminals, protruding through the top and the bottom of the case and having
  - an upper end protruding out of the top of the case;
  - a lower end protruding out of the bottom of the case;
  - a side surface; and
  - two mounting recesses being oppositely formed in the side surface of the driving connector;
- an annular connector being elastic, being mounted in the case, between the terminals and around the driving connector and having
  - two opposite ends;
  - an inner edge;
  - two conducting protrusions being respectively formed on the annular connector adjacent to the ends of the annular connector and respectively corresponding to the conducting protrusions of the terminals; and
  - two elastic positioning protrusions being respectively formed on the inner edge of the annular connector, respectively corresponding to the ends of the annular connector and respectively engaging the mounting recesses of the driving connector; and
- a connecting rod being pivotally connected to the bottom of the case, being mounted around the lower end of the driving connector, being securely connected to the connecting rod of the float and having
  - a proximal end being pivotally connected to the bottom of the case; and
  - a distal end being connected to the connecting rod of the float.

4. The dehumidifier as claimed in claim 2, wherein the attachment actuator further has
- a mounting cover being mounted on the housing and having
  - an outer surface;
  - an inner surface;
  - a mounting recess being formed in the outer surface of the mounting cover; and
  - a Y-shaped recess being formed in the outer surface of the mounting cover and communicating with the mounting recess of the mounting cover;
- the switch of the attachment actuator being mounted on the inner surface of the mounting cover;
- a restore assembly being tubular, being mounted through the mounting cover in the mounting recess of the mounting cover and having
  - an outer open end, and
  - an inner open end being connected to the connecting pipe;

a positioning cover being pivotally connected to the mounting cover in the mounting recess of the mounting cover, corresponding to the restore assembly and having a through hole being formed through the positioning cover; and an attachment connector being mounted on the positioning cover, in the Y-shaped recess of the mounting cover and through the through hole of the positioning cover and corresponding to the switch.

5. The dehumidifier as claimed in claim 4, wherein the restore assembly of the attachment actuator further has an annular shoulder being formed around the inner surface of the restore assembly;

a spring being mounted in the restore assembly between the outer open end and the annular shoulder of the restore assembly and having an inner end abutting the annular shoulder of the restore assembly; and an outer end; and a stopper being mounted on the outer end of the spring of the restore assembly and corresponding to the outer open end of the restore assembly;

the dehumidifier further has a middle assembly being tubular, being connected to and aligning with the restore assembly and having an inner open end being mounted around the outer open end of the restore assembly;

an outer open end;

an outer surface;

an annular shoulder being formed around the outer surface of the middle assembly;

two arc recesses being formed through the outer surface of the middle assembly and each arc recess having two ends corresponding to each other;

two pins being respectively mounted through the arc recesses and each pin being mounted in the ends of the corresponding arc recess and having two ends; and four springs being respectively mounted between the ends of the pins and the annular shoulder of the middle assembly; and a sustaining assembly being tubular, being mounted around the middle assembly and in the mounting recess of the mounting cover and having an inner open end abutting the mounting cover;

an outer open end;

an inner surface; and an annular shoulder being formed around the inner surface of the sustaining assembly adjacent to the outer open end of the sustaining assembly and abutting the pins of the middle assembly;

the positioning cover of the attachment actuator pressing against the outer open end of the sustaining assembly; and the through hole of the positioning cover corresponding to the sustaining assembly.

6. The dehumidifier as claimed in claim 5, wherein the attachment connector of the attachment actuator further has a connecting tube being tubular, being mounted through the through hole of the positioning cover and in the middle assembly, abutting the stopper of the restore assembly and having an inner end abutting the stopper of the restore assembly;

an outer end;

an outer surface; and an annular recess being formed around the connecting tube and corresponding to the arc recesses of the middle assembly; and a button corresponding to and being mounted in the Y-shaped recess of the mounting cover and selectively pressing against the switch of the mounting cover.

7. The dehumidifier as claimed in claim 2, wherein the bottom of the container further has an outer bottom; and an inner bottom being shallower than the outer bottom and being sloped from the inner end of the container to the outer bottom of the container.

8. The dehumidifier as claimed in claim 1, wherein the container further has a collecting tube being formed on and protruding transversely through the bottom of the container and having an inner open end protruding higher than the bottom of the container; and the dehumidifier further has a water-storage tank being mounted in the housing and communicating the collecting tube of the container.

9. The dehumidifier as claimed in claim 2, wherein the container further has a collecting tube being formed on and protruding transversely through the bottom of the container and having an inner open end protruding higher than the bottom of the container; and the dehumidifier further has a water-storage tank being mounted in the housing and communicating the collecting tube of the container.

10. The dehumidifier as claimed in claim 9, wherein the float actuator further has a case having a top; and a bottom;

two terminals being oppositely mounted in the case and protruding through the top of the case and each terminal having an outer end;

an inner end; and a conducting protrusion being formed on the inner end of the terminal;

a driving connector being mounted in the case and between the terminals, protruding through the top and the bottom of the case and having an upper end protruding out of the top of the case;

a lower end protruding out of the bottom of the case;

a side surface; and two mounting recesses being oppositely formed in the side surface of the driving connector;

an annular connector being elastic, being mounted in the case, between the terminals and around the driving connector and having two opposite ends;

an inner edge;

two conducting protrusions being respectively formed on the annular connector adjacent to the ends of the annular connector and respectively corresponding to the conducting protrusions of the terminals; and two elastic positioning protrusions being respectively formed on the inner edge of the annular connector, respectively corresponding to the ends of the annular connector and respectively engaging the mounting recesses of the driving connector; and a connecting rod being pivotally connected to the bottom of the case, being mounted around the lower end of the driving connector, being securely connected to the connecting rod of the float and having a proximal end being pivotally connected to the bottom of the case; and a distal end being connected to the connecting rod of the float.

11. The dehumidifier as claimed in claim 8, wherein the float actuator further has a case having a top; and a bottom;

two terminals being oppositely mounted in the case and protruding through the top of the case and each terminal having an outer end;

an inner end; and a conducting protrusion being formed on the inner end of the terminal;

a driving connector being mounted in the case and between the terminals, protruding through the top and the bottom of the case and having an upper end protruding out of the top of the case;

a lower end protruding out of the bottom of the case;

a side surface; and two mounting recesses being oppositely formed in the side surface of the driving connector;

an annular connector being elastic, being mounted in the case, between the terminals and around the driving connector and having two opposite ends;

an inner edge;

two conducting protrusions being respectively formed on the annular connector adjacent to the ends of the annular connector and respectively corresponding to the conducting protrusions of the terminals; and two elastic positioning protrusions being respectively formed on the inner edge of the annular connector, respectively corresponding to the ends of the annular connector and respectively engaging the mounting recesses of the driving connector; and a connecting rod being pivotally connected to the bottom of the case, being mounted around the lower end of the driving connector, being securely connected to the connecting rod of the float and having a proximal end being pivotally connected to the bottom of the case; and a distal end being connected to the connecting rod of the float.

12. The dehumidifier as claimed in claim 1, wherein the float actuator further has a case having a top; and a bottom;

two terminals being oppositely mounted in the case and protruding through the top of the case and each terminal having an outer end;

an inner end; and a conducting protrusion being formed on the inner end of the terminal;

a driving connector being mounted in the case and between the terminals, protruding through the top and the bottom of the case and having an upper end protruding out of the top of the case;

a lower end protruding out of the bottom of the case;

a side surface; and two mounting recesses being oppositely formed in the side surface of the driving connector;

an annular connector being elastic, being mounted in the case, between the terminals and around the driving connector and having two opposite ends;

an inner edge;

two conducting protrusions being respectively formed on the annular connector adjacent to the ends of the annular connector and respectively corresponding to the conducting protrusions of the terminals; and two elastic positioning protrusions being respectively formed on the inner edge of the annular connector, respectively corresponding to the ends of the annular connector and respectively engaging the mounting recesses of the driving connector; and a connecting rod being pivotally connected to the bottom of the case, being mounted around the lower end of the driving connector, being securely connected to the connecting rod of the float and having a proximal end being pivotally connected to the bottom of the case; and a distal end being connected to the connecting rod of the float.

13. The dehumidifier as claimed in claim 1, wherein the attachment actuator further has a mounting cover being mounted on the housing and having an outer surface;

an inner surface;

a mounting recess being formed in the outer surface of the mounting cover; and a Y-shaped recess being formed in the outer surface of the mounting cover and communicating with the mounting recess of the mounting cover;

the switch of the attachment actuator being mounted on the inner surface of the mounting cover;

a restore assembly being tubular, being mounted through the mounting cover in the mounting recess of the mounting cover and having an outer open end; and an inner open end being connected to the connecting pipe;

a positioning cover being pivotally connected to the mounting cover in the mounting recess of the mounting cover, corresponding to the restore assembly and having a through hole being formed through the positioning cover; and an attachment connector being mounted on the positioning cover, in the Y-shaped recess of the mounting cover and through the through hole of the positioning cover and corresponding to the switch.

14. The dehumidifier as claimed in claim 13, wherein the restore assembly of the attachment actuator further has an annular shoulder being formed around the inner surface of the restore assembly;

a spring being mounted in the restore assembly between the outer open end and the annular shoulder of the restore assembly and having an inner end abutting the annular shoulder of the restore assembly; and an outer end; and a stopper being mounted on the outer end of the spring of the restore assembly and corresponding to the outer open end of the restore assembly;

the dehumidifier further has a middle assembly being tubular, being connected to and aligning with the restore assembly and having an inner open end being mounted around the outer open end of the restore assembly;

an outer open end;

an outer surface;

an annular shoulder being formed around the outer surface of the middle assembly;

two arc recesses being formed through the outer surface of the middle assembly and each arc recess having two ends corresponding to each other;

two pins being respectively mounted through the arc recesses and each pin being mounted in the ends of the corresponding arc recess and having two ends; and four springs being respectively mounted between the ends of the pins and the annular shoulder of the middle assembly; and a sustaining assembly being tubular, being mounted around the middle assembly and in the mounting recess of the mounting cover and having an inner open end abutting the mounting cover;

an outer open end;

an inner surface; and an annular shoulder being formed around the inner surface of the sustaining assembly adjacent to the outer open end of the sustaining assembly and abutting the pins of the middle assembly;

the positioning cover of the attachment actuator pressing against the outer open end of the sustaining assembly; and the through hole of the positioning cover corresponding to the sustaining assembly.

15. The dehumidifier as claimed in claim 14, wherein the attachment connector of the attachment actuator further has a connecting tube being tubular, being mounted through the through hole of the positioning cover and in the middle assembly, abutting the stopper of the restore assembly and having an inner end abutting the stopper of the restore assembly;

an outer end;

an outer surface; and an annular recess being formed around the connecting tube and corresponding to the arc recesses of the middle assembly; and a button corresponding to and being mounted in the Y-shaped recess of the mounting cover and selectively pressing against the switch of the mounting cover.

16. The dehumidifier as claimed in claim 1, wherein the bottom of the container further has an outer bottom; and an inner bottom being shallower than the outer bottom and having a slope from the inner end of the container to the outer bottom of the container.

* * * * *